US010899131B2

(12) United States Patent
Asai

(10) Patent No.: US 10,899,131 B2
(45) Date of Patent: Jan. 26, 2021

(54) PRINTING APPARATUS, PRINTING SYSTEM, PRINTING METHOD

(71) Applicant: SCREEN HOLDINGS CO., LTD., Kyoto (JP)

(72) Inventor: Hiroshi Asai, Kyoto (JP)

(73) Assignee: SCREEN HOLDINGS CO., LTD., Kyoto (JP)

( * ) Notice: Subject to any disclaimer, the term of this patent is extended or adjusted under 35 U.S.C. 154(b) by 0 days.

(21) Appl. No.: 16/547,233

(22) Filed: Aug. 21, 2019

(65) Prior Publication Data

US 2020/0086645 A1 Mar. 19, 2020

(30) Foreign Application Priority Data

Sep. 19, 2018 (JP) ..... 2018-175016

(51) Int. Cl.
*B41J 2/165* (2006.01)
*B41J 2/175* (2006.01)
*B41J 2/17* (2006.01)

(52) U.S. Cl.
CPC ..... *B41J 2/16517* (2013.01); *B41J 2/1707* (2013.01); *B41J 2/17566* (2013.01)

(58) Field of Classification Search
CPC .. B41J 2/16517; B41J 2/1707; B41J 2/17566; B41J 2/1652; B41J 2/16552; B41J 2002/16502; B41J 2002/16529; B41J 2002/16597
See application file for complete search history.

(56) References Cited

U.S. PATENT DOCUMENTS

| | | | |
|---|---|---|---|
| 8,287,087 | B2 | 10/2012 | Sano |
| 2006/0290739 | A1 | 12/2006 | Hatayama |
| 2012/0081446 | A1 | 4/2012 | Usuda et al. |

FOREIGN PATENT DOCUMENTS

| | | | |
|---|---|---|---|
| CN | 102555453 | A | 7/2012 |
| EP | 0 790 128 | A2 | 8/1997 |
| JP | 2007-001118 | A | 1/2007 |
| JP | 2010-208217 | A | 9/2010 |

OTHER PUBLICATIONS

Extended European Search Report issued in corresponding European Patent Application No. 19192208.7-1017, dated Jan. 16, 2020.
Chinese Office Action issued in corresponding Chinese Patent Application No. 201910744005.8, dated Sep. 1, 2020.

*Primary Examiner* — Kristal Feggins
(74) *Attorney, Agent, or Firm* — McDermott Will & Emery LLP

(57) ABSTRACT

A printing apparatus performs image printing by controlling discharge of a color ink from a color ink printing part on the basis of print data and performing flushing in which the color ink printing part is caused to discharge the color ink, separately from the discharge of the color ink on the basis of the print data, wherein a control part controls a flushing print rate indicating the area to which the color ink discharged in the flushing is adhered per unit area of a printing medium in accordance with a result of determining a white region to which only white ink is adhered and a color region to which the color ink is adhered in the printing medium on the basis of the print data, and the flushing print rate for the white region is lower than the flushing print rate for the color region.

12 Claims, 9 Drawing Sheets

FIG. 9

| TYPE OF REGION | WHITE REGION | TRANSPARENT REGION | LOW-DENSITY COLOR REGION | HIGH-DENSITY COLOR REGION |
|---|---|---|---|---|
| FLUSHING PRINT RATE | F1 | F2 | F3 | F4 |

PRINTING APPARATUS, PRINTING SYSTEM, PRINTING METHOD

CROSS REFERENCE TO RELATED APPLICATION

The disclosure of Japanese Patent Application No. 2018-175016 filed on Sep. 19, 2018 including specification, drawings and claims is incorporated herein by reference in its entirety.

BACKGROUND OF THE INVENTION

1. Field of the Invention

The present invention relates to a technology for printing an image on a printing medium by discharging ink from a nozzle, and more particularly to a technology for performing maintenance of the nozzle.

2. Description of the Related Art

Conventionally, an inkjet printer that prints an image represented by print data on a printing medium by discharging ink from a nozzle on the basis of the print data has been well known. In such a printer, in order to suppress clogging of the nozzle with dry ink and/or discharge failure caused by mixture of air to the inside of the nozzle or the like, flushing in which the ink is discharged (exhausted) from the nozzle onto the printing medium is performed as appropriate.

Further, Japanese Patent Application Laid Open Gazette No. 2007-001118 (Patent Document 1) discloses a printer that performs flushing in parallel with image printing in which an image is printed on a printing medium on the basis of print data. Particularly in Patent Document 1, in order to prevent dots of ink adhered to the printing medium by the flushing from becoming outstanding and affecting the image, selected is a region on which the dots of the ink are landed out of the image.

SUMMARY OF THE INVENTION

An image can be printed by using white ink besides color inks such as yellow, magenta, cyan, and black. This white ink is used for filling a region serving as, for example, a background with white, and the like. At that time, there are some cases where the color ink discharged for the flushing is adhered to the white region and therefore the color ink becomes outstanding in the white region and affects the image in the white region.

The present invention is intended to solve the above problem, and it is an object of the present invention to provide a technology to make it possible to suppress the color ink discharged by the flushing from becoming outstanding in the white region.

A printing apparatus according the invention comprises: a medium supporting part configured to support a printing medium; a color ink printing part configured to discharge color ink having a color different from white from a nozzle onto the printing medium; and a control part configured to perform image printing in which an image is printed onto the printing medium by controlling discharge of the color ink from the color ink printing part on the basis of print data representing the image to be printed onto the printing medium and performing flushing in which the color ink printing part is caused to discharge the color ink, separately from the discharge of the color ink on the basis of the print data, in parallel with the image printing, wherein the control part controls a flushing print rate indicating the area to which the color ink discharged in the flushing is adhered per unit area of the printing medium in accordance with a result of determining a white region to which only white ink is adhered and a color region to which the color ink is adhered in the printing medium on the basis of the print data, and the flushing print rate for the white region is lower than the flushing print rate for the color region.

A printing method according to the invention comprises: performing image printing in which an image is printed onto a printing medium by discharging color ink having a color different from white from a nozzle on the basis of print data representing the image to be printed onto the printing medium; and performing flushing in which the color ink is discharged from the nozzle, separately from discharge of the color ink on the basis of the print data, in parallel with the image printing, wherein a flushing print rate is controlled, which indicates the area to which the color ink discharged in the flushing is adhered per unit area of the printing medium in accordance with a result of determining a white region to which only white ink is adhered and a color region to which the color ink is adhered in the printing medium on the basis of the print data, and the flushing print rate for the white region is lower than the flushing print rate for the color region.

In the present invention (the printing apparatus, the printing method) having such a configuration, the white region to which only the white ink is adhered and the color region to which the color ink is adhered in the printing medium are determined on the basis of the print data. Then, the flushing is performed so that the flushing print rate for the white region becomes lower than the flushing print rate for the color region. Thus, it becomes possible to suppress the color ink discharged in the flushing from becoming outstanding in the white region.

The above and further objects and novel features of the invention will more fully appear from the following detailed description when the same is read in connection with the accompanying drawing. It is to be expressly understood, however, that the drawing is for purpose of illustration only and is not intended as a definition of the limits of the invention.

BRIEF DESCRIPTION OF THE DRAWINGS

FIG. 9 is a view showing one example of a table defining a relation between the type of region and the flushing print rate.

DETAILED DESCRIPTION OF THE PREFERRED EMBODIMENTS

Figure 1:
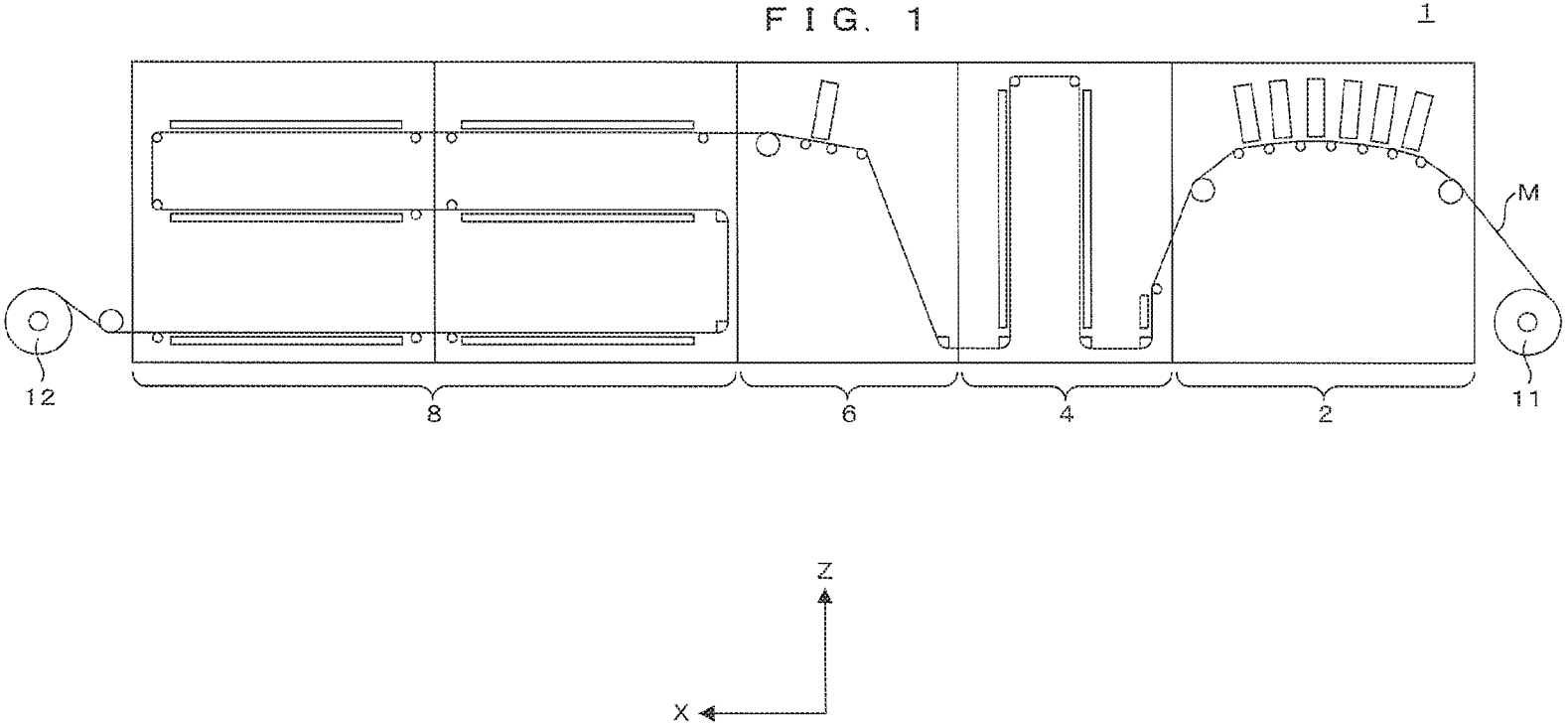
FIG. 1 is a front elevational view schematically showing one example of a printing system in accordance with the present invention.

FIG. 1 is a front elevational view schematically showing one example of a printing system in accordance with the present invention. In FIG. 1 and the following figures, a horizontal direction X and a vertical direction Z are shown as appropriate. As shown in FIG. 1, a printing system 1 includes a configuration in which a prestage printer 2, a prestage dryer 4, a post-stage printer 6, and a post-stage dryer 8 which have the same height as one another are arranged in this order in the horizontal direction X. This printing system 1 transfers a printing medium M from a unwind roll 11 to a rewind roll 12 in a roll-to-roll process while causing the prestage dryer 4 to dry the printing medium M printed by the prestage printer 2 and causing the post-stage dryer 8 to dry the printing medium M printed by the post-stage printer 6. Herein, an exemplary case where printing is performed on the printing medium M which is a transparent film by using water-based ink will be shown. Further, hereinafter, among both surfaces of the printing medium M, the surface on which an image is printed is referred to as a front surface and the other surface opposite to the front surface is referred to as a back surface as appropriate.

Figure 2:
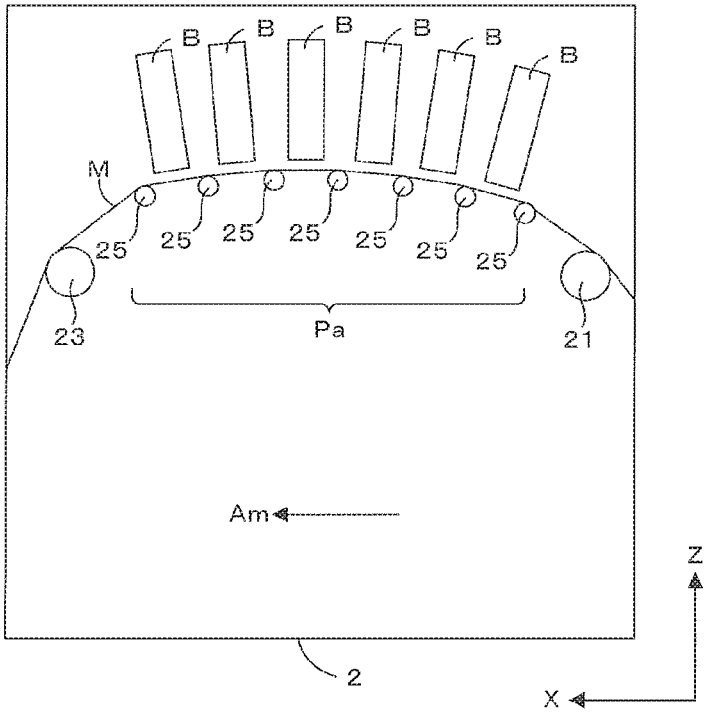
FIG. 2 is a front elevational view schematically showing a prestage printer included in the printing system of FIG. 1.

FIG. 2 is a front elevational view schematically showing a prestage printer included in the printing system of FIG. 1. In the prestage printer 2, the printing medium M is fed along a feed direction Am directed from right to left in this figure. This prestage printer 2 has a loading roller 21 for loading the printing medium M fed from the feed roll 11 and an unloading roller 23 for unloading the printing medium M toward the prestage dryer 4. The loading roller 21 and the unloading roller 23 wind up the back surface of the printing medium M from below and drive the printing medium M in the feed direction Am. Further, the prestage printer 2 has a plurality of backup rollers 25 disposed between the loading roller 21 and the unloading roller 23 in the feed direction Am. These backup rollers 25 each wind up the back surface of the printing medium M to be fed in the feed direction Am from below, to thereby support the printing medium M.

Among the plurality of backup rollers 25, between the backup roller 25 on the most upstream side and the backup roller 25 on the most downstream side in the feed direction Am, a prestage print path Pa is formed. The backup roller 25 on the most upstream side and the backup roller 25 on the most downstream side support the printing medium M at the same height, and each of the backup rollers 25 disposed inside the prestage print path Pa supports the printing medium M at a higher height as disposed more inside.

Further, the prestage printer 2 includes a plurality of print bars B facing the front surface of the printing medium M, the plurality of print bars B are aligned in the feed direction Am above the printing medium M fed along the prestage print path Pa. Specifically, each print bar B is disposed with respect to the front surface of the printing medium M proceeding between the two adjacent backup rollers 25 and discharges ink by the inkjet method onto the front surface of the printing medium M supported on both sides by the two backup rollers 25. In the exemplary case shown herein, provided are six print bars B including four print bars B that discharge inks of four process colors (yellow, magenta, cyan, and black) and two print bars B that discharge inks of two special colors (orange and violet). Therefore, the prestage printer 2 can print a color image on the front surface of the printing medium M by using the six print bars B which discharge color inks of different colors from one another.

The printing medium M on which the image is printed in the prestage print path Pa goes down diagonally between the backup roller 25 on the most downstream side of the prestage print path Pa and the unloading roller 23 to reach the unloading roller 23. This unloading roller 23 winds up the back surface of the printing medium M from below on the downstream side of the plurality of backup rollers 25 in the feed direction Am. Then, the unloading roller 23 unloads the printing medium M to the prestage dryer 4. Further, the unloading roller 23 is a suction roller that sucks the back surface of the printing medium M, and suppresses transmission of the oscillation of the printing medium M from the prestage dryer 4 to the prestage printer 2 to stabilize the position of the printing medium M in the prestage print path Pa. As a result, it becomes possible to suppress the feed of the printing medium M in the prestage dryer 4 from affecting the printing in the prestage printer 2.

As shown in FIG. 1, the prestage dryer 4 dries the printing medium M while turning the feed direction Am of the printing medium M to the vertical direction Z as appropriate. Then, the printing medium M dried by the prestage dryer 4 is unloaded from the prestage dryer 4 to the post-stage printer 6.

Figure 3:
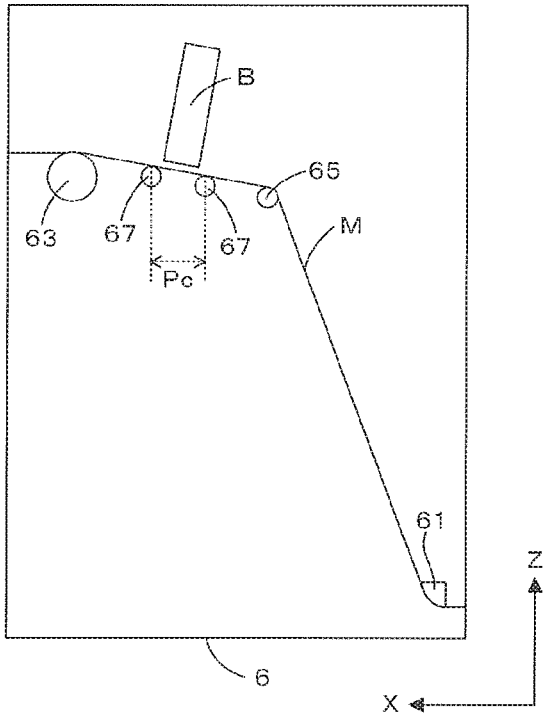
FIG. 3 is a front elevational view schematically showing a post-stage printer included in the printing system of FIG. 1.

FIG. 3 is a front elevational view schematically showing a post-stage printer included in the printing system of FIG. 1. The post-stage printer 6 has an air turn bar 61 for bending the printing medium M diagonally upward, which is unloaded from the prestage dryer 4 in the horizontal direction X. This air turn bar 61 winds up the front surface of the printing medium M while providing a clearance between itself and the front surface of the printing medium M by injection of air. Further, the post-stage printer 6 has an unloading roller 63 for unloading the printing medium M to the post-stage dryer 8 and a conveying roller 65 disposed between the air turn bar 61 and the unloading roller 63. The conveying roller 65 and the unloading roller 63 wind up the back surface of the printing medium M from below and drive the printing medium M in the feed direction Am.

Furthermore, the post-stage printer 6 has two backup rollers 67 between the conveying roller 65 and the unloading roller 63. Between the two backup rollers 67, a post-stage print path Pc is formed. Further, the post-stage printer 6 includes a print bar B facing the front surface of the printing medium M above the printing medium M conveyed along the post-stage print path Pc.

Specifically, the print bar B is disposed with respect to the front surface of the printing medium M proceeding between the two backup rollers 67 and discharges ink by the inkjet method onto the front surface of the printing medium M supported on both sides by the two backup rollers 67. In the exemplary case shown herein, the print bar B discharges white ink. Therefore, the post-stage printer 6 can print a white background image on the front surface of the printing medium M by using the print bar B with respect to the color image printed by the prestage printer 2.

The printing medium M on which the image is printed in the post-stage print path Pc goes up diagonally between the backup roller 67 on the most downstream side of the post-stage print path Pc and the unloading roller 63 to reach the unloading roller 63. This unloading roller 63 winds up the printing medium M from below on the downstream side of the two backup rollers 67 in the feed direction Am. Thus, the unloading roller 63 unloads the printing medium M to the post-stage dryer 8 along a path in which the printing medium M moves in the horizontal direction X by winding up the printing medium M which has been going up diagonally from the post-stage print path Pc. Further, the unloading roller 63 is a suction roller that sucks the back surface of the printing medium M, and suppresses transmission of the oscillation of the printing medium M from the post-stage dryer 8 to the post-stage printer 6 to stabilize the position of the printing medium M in the post-stage print path Pc. As a result, it becomes possible to suppress the feed of the printing medium M in the post-stage dryer 8 from affecting the printing in the post-stage printer 6.

As shown in FIG. 1, the post-stage dryer 8 dries the printing medium M while turning the feed direction Am of the printing medium M to the horizontal direction X as appropriate. Then, the printing medium M dried by the post-stage dryer 8 is unloaded from the post-stage dryer 8 and wound up by the rewind roll 12.

Figure 4:
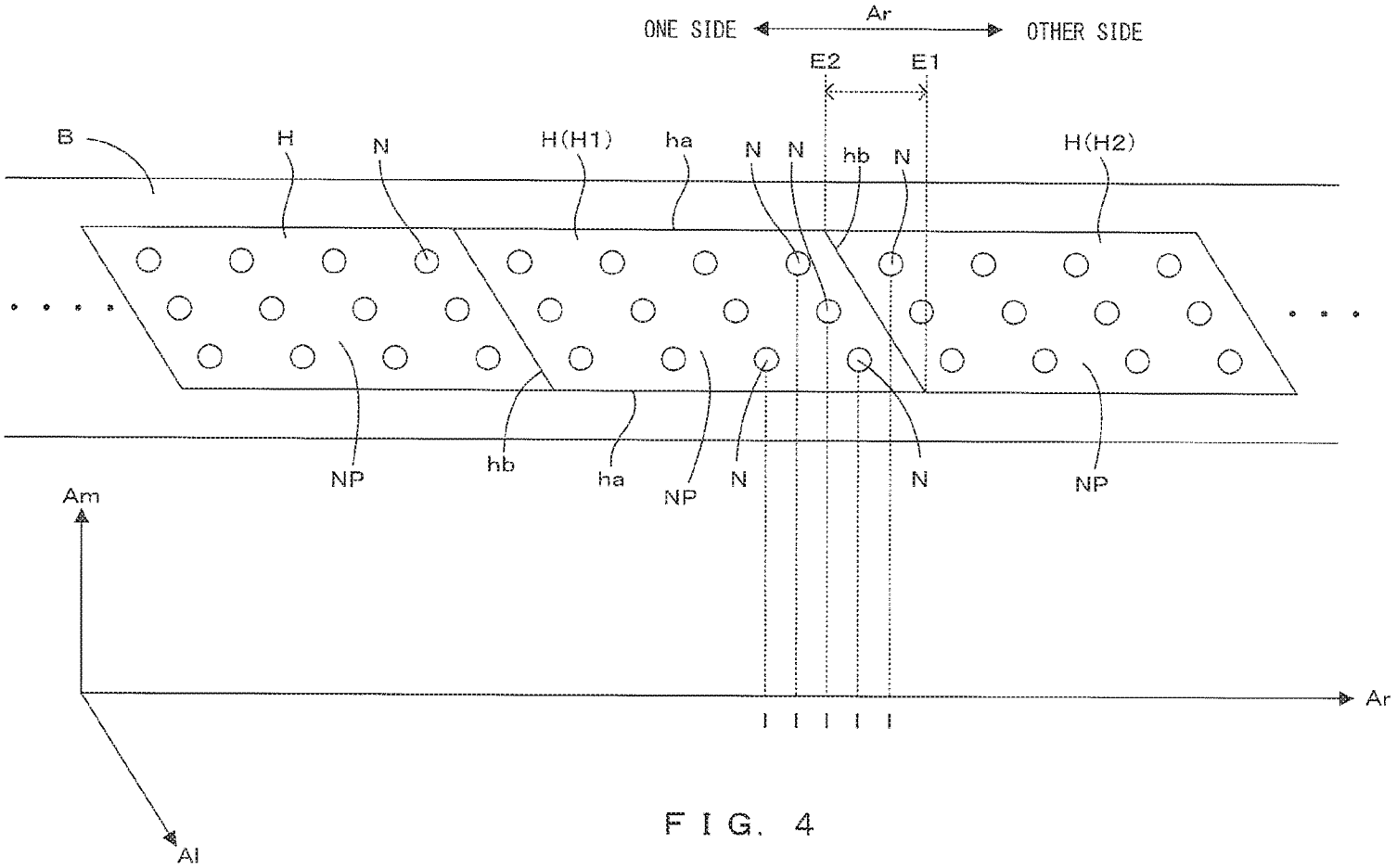
FIG. 4 is a bottom view schematically showing a configuration of print heads included in the prestage printer and the post-stage printer.

FIG. 4 is a bottom view schematically showing a configuration of print heads included in the prestage printer and the post-stage printer. This figure shows the feed direction Am, an orthogonal direction Ar orthogonal to the feed direction Am, and a tilt direction Al tilted with respect to the feed direction Am and the orthogonal direction Ar. Further, with respect to the orthogonal direction Ar, one side and the other side opposite to the one side are shown.

The print bar B has a long-length shape in the orthogonal direction Ar, and on the bottom of the print bar B, a plurality of print heads H are aligned in a row in the orthogonal direction Ar. Each of the print heads H has a nozzle forming surface NP having a planar shape on its bottom, and a plurality of nozzles N open in the nozzle forming surface NP. The plurality of nozzles N are disposed at different positions 1 from one another in the orthogonal direction Ar and the respective positions 1 of the nozzles N in the orthogonal direction Ar are arranged at a regular pitch. Further, three nozzles N whose positions are adjacent to one another in the orthogonal direction Ar are arranged in parallel with the tilt direction Al to form a group, and groups each including these three nozzles N are further arranged periodically in the orthogonal direction Ar. Herein, the position of the nozzle N in the orthogonal direction Ar is obtained as a position at which a straight line passing through the center of the nozzle N, in parallel with the feed direction Am, intersects a coordinate axis indicating the orthogonal direction Ar, and corresponds to the components of the coordinate axis. Thus, in the print heads H, the plurality of nozzles N are arranged in a staggered manner. Further, though FIG. 4 shows an exemplary case where the plurality of nozzles N are arranged in a three-row staggered arrangement, the arrangement of the nozzles N is not limited to this case.

The nozzle forming surface NP of each print head H has a parallelogram formed of two sides ha facing each other, which are in parallel with the orthogonal direction Ar, and two sides hb facing each other, which are in parallel with the tilt direction Al. Then, the plurality of print heads H are arranged so that respective sides hb of two adjacent print heads H in the orthogonal direction Ar face and are in proximity to one another. Thus, since the end sides hb of the nozzle forming surface NP in the orthogonal direction Ar are tilted, the nozzle forming surfaces NP of the two adjacent print heads H partially overlap each other in the orthogonal direction Ar at end portions on their boundary side. In other words, in the orthogonal direction Ar, among the two adjacent print heads H1 and H2, an end E1 on the other side of the nozzle forming surface NP of the print head H1 on the one side is located more on the other side than an end E2 on the one side of the nozzle forming surface NP of the print head H2 on the other side.

Thus, on the bottom of the print bar B, since the plurality of print heads H are aligned in a row in the orthogonal direction Ar, a multiple of nozzles N are arranged at a regular pitch at the different positions from one another in the orthogonal direction Ar. Then, these nozzles N each discharge the ink by the inkjet method.

Figure 6:
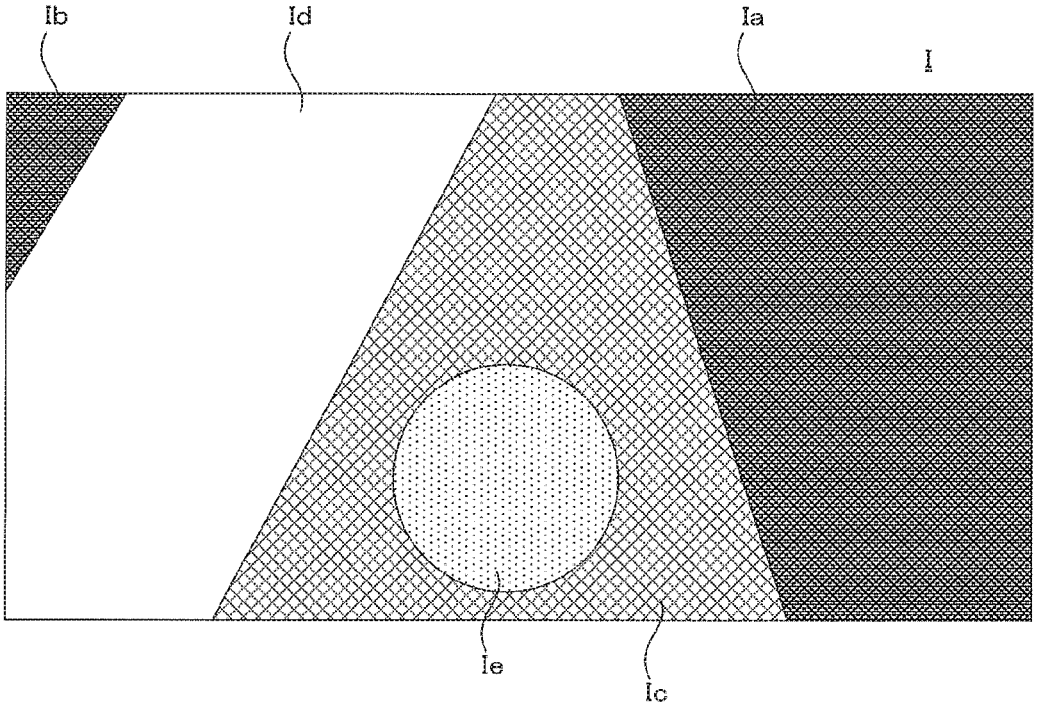
FIG. 6 is a plan view schematically showing the image to be printed on the printing medium in the image printing performed by the printing system.

In the exemplary case shown in FIG. 6, the image I includes five regions Ia to Ie. The regions Ia, Ib, and Ic of the image I are color regions Ia, Ib, and Ic formed of color inks (yellow, magenta, cyan, black, and orange or violet described above). The print bars B included in the prestage printer 2 discharge the color inks onto the printing medium M from the nozzles N to print these color regions Ia, Ib, and Ic included in the image I. Among the color regions Ia, Ib, and Ic, the optical transparency of the color region Ic is higher than the optical transparency of each of the color regions Ia and Ib. The region Id is a white region Id formed of only white ink. The print head H included in the post-stage printer 6 discharges the white ink onto the printing medium M from the nozzles N to print the white region Id included in the image I. Further, the region Ie of the image I is a transparent region Ie on which neither the color ink nor the white ink is adhered and the front surface Ma of the printing medium M is exposed.

Figure 7:
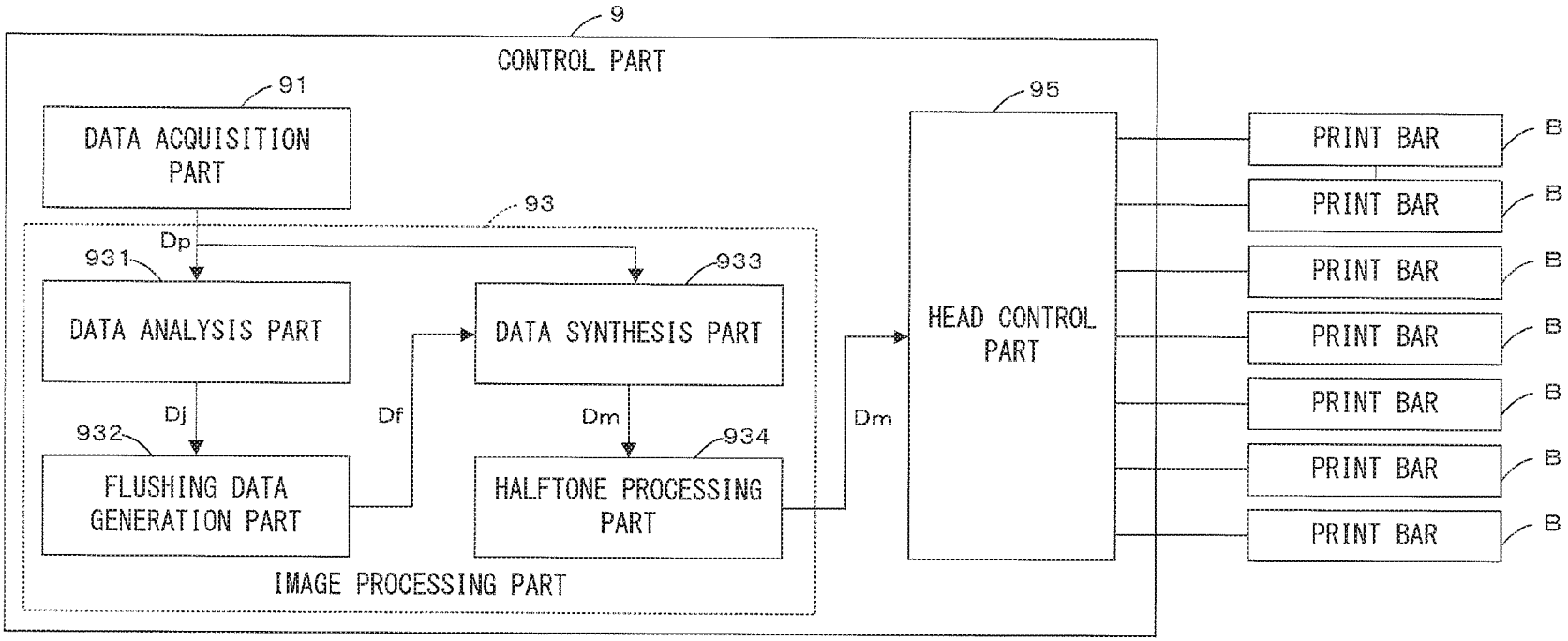
FIG. 7 is a block diagram showing an electrical structure provided in the printing system of FIG. 1.

FIG. 7 is a block diagram showing an electrical structure provided in the printing system of FIG. 1. As shown in FIG. 7, the printing system 1 has a control part 9 that generally controls the whole of this system. This control part 9 performs image printing in which the image I is printed onto the printing medium M by controlling discharge of the color inks from the nozzles N of the print bars B in the prestage printer 2 and discharge of the white ink from the nozzles N of the print bar B in the post-stage printer 6 on the basis of print data Dp representing the image I to be printed onto the printing medium M. Further, the control part 9 performs maintenance of the nozzles N by performing flushing in which the color inks are discharged from the nozzles N of the print bars B in the prestage printer 2, separately from the discharge of the color inks on the basis of the print data Dp, in parallel with the image printing. Subsequently, a specific configuration for performing the image printing and the flushing in parallel will be described.

The control part 9 includes a data acquisition part 91, an image processing part 93, and a head control part 95. The data acquisition part 91 acquires the print data Dp. The acquisition of the print data Dp is performed, for example, by inputs from the outside by a user or generation using a data generation program. This print data Dp represent the image I to be printed on the printing medium M by indicating a pixel value of each pixel in multitone (for example, 256 tones) for each of the colors (yellow, magenta, cyan, black, orange, violet, and white).

The image processing part 93 is formed of a processor and a memory, and has a data analysis part 931, a flushing data generation part 932, a data synthesis part 933, and a halftone processing part 934. The data analysis part 931 analyzes the print data Dp received from the data acquisition part 91, to thereby perform a region determination. In this region determination, the data analysis part 931 determines whether the color region, the white region, or the transparent region described above is present in the image I or not on the basis of the print data Dp and then specifies the location of the region which is determined to be present among the color region, the white region, and the transparent region.

Specifically, when the image I has a region which has a predetermined area or more to which the color ink is adhered on the printing medium M, it is determined that a color region (the color region Ia, Ib, or Ic in the exemplary case of FIG. 6) is present and the location of this color region is specified. On the other hand, when the image I does not have a region which has the predetermined area or more to which the color ink is adhered, it is determined that no color region is present. Further, as the area to which the color ink is adhered, which is used for the determination on whether there is a color region or not, a value of the area which is determined, for example, from an experiment or the like may be set.

When the image I has a region which has a predetermined area or more to which the white ink is adhered on the printing medium M, it is determined that a white region (the white region Id in the exemplary case of FIG. 6) is present and the location of this white region is specified. On the other hand, when the image I does not have a region which has the predetermined area or more to which the white ink is adhered, it is determined that no white region is present. Further, as the area to which the white ink is adhered, which is used for the determination on whether there is a white region or not, a value of the area which is determined, for example, from an experiment or the like may be set.

When the image I has a region which has a predetermined area or more to which neither the color ink nor the white ink is adhered on the printing medium M, it is determined that a transparent region (the transparent region Ie in the exemplary case of FIG. 6) is present and the location of this transparent region is specified. On the other hand, when the image I does not have a region which has the predetermined area or more to which neither the color ink nor the white ink is adhered, it is determined that no transparent region is present. Further, as the area to which neither the color ink nor the white ink is adhered, which is used for the determination on whether there is a transparent region or not, a value of the area which is determined, for example, from an experiment or the like may be set.

Furthermore, the data analysis part 931 performs an optical transparency determination on the basis of the result of the region determination. Specifically, in this optical transparency determination, it is determined whether or not the optical transparency of the color region which is determined to be present is not smaller than a threshold value. Then, the color region having an optical transparency not smaller than the threshold value is determined to be a low-density color region (the color region Ic in the exemplary case of FIG. 6) and the color region having an optical transparency smaller than the threshold value is determined to be a high-density color region (the color regions Ia and Ib in the exemplary case of FIG. 6).

A determination result Dj obtained from the region determination and the optical transparency determination is sent from the data analysis part 931 to the flushing data generation part 932, and the flushing data generation part 932 determines a print rate of the color ink in the flushing (flushing print rate) on the basis of the determination result Dj. This flushing print rate indicates the area to which the color ink discharged in the flushing is adhered, per unit area of the printing medium M.

Figure 8:
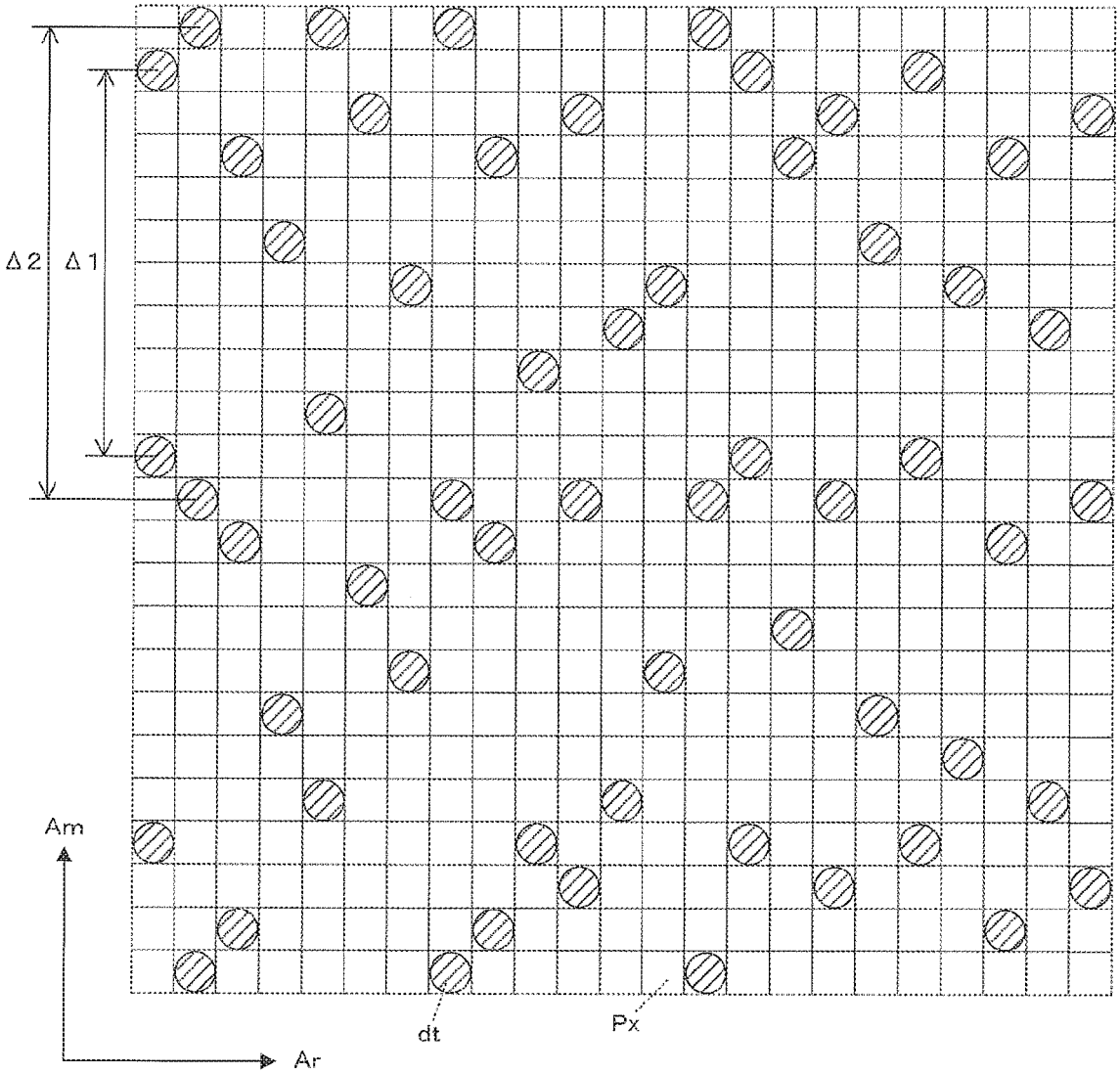
FIG. 8 is a view schematically explaining the flushing print rate.

FIG. 8 is a view schematically explaining the flushing print rate. The image processing part 93 virtually sets a plurality of pixels Px arranged in a matrix with respect to the front surface Ma of the printing medium M. The plurality of nozzles N disposed at the different positions in the orthogonal direction Ar in the print bar B shown in FIG. 4 discharge dots dt of the ink onto the pixels Px located at different positions from one another in the orthogonal direction Ar. Specifically, in the image printing, the plurality of nozzles N discharge the inks at a predetermined timing onto the printing medium M fed in the feed direction Am so that the dots dt of the plurality of inks are arranged two-dimensionally on the front surface Ma of the printing medium M, to form the image I.

Then, as shown in FIG. 8, the flushing data generation part 932 generates flushing data Df indicating which pixel Px among the plurality of pixels Px included in the unit area, the dots dt of the color inks should be selectively discharged to. When the pixel value of the pixel Px is represented by 256 tones, for example, the flushing data Df is generated by setting the tone value of the pixel Px to which the dots dt are discharged to "256" and setting the tone value of the pixel Px to which no dot dt is discharged to "0". At that time, the flushing data generation part 932 generates the flushing data Df having a flushing print rate in accordance with the type of region to be determined in the region determination, on the basis of the determination result Dj.

FIG. 9 is a view showing one example of a table defining a relation between the type of region and the flushing print rate. The flushing data generation part 932 generates the flushing data Df with reference to the table in this figure. As shown in this figure, the flushing print rates F1, F2, F3, and F4 are set with respect to the white region, the transparent region, the low-density color region, and the high-density color region, respectively, and the flushing print rates F1, F2, F3, and F4 (F1<F2<F3<F4) which become higher in this order are set for the white region, the transparent region, the low-density color region, and the high-density color region in this order. When the image I exemplarily shown in FIG. 6 is printed, the flushing data Df is thereby generated, in which the flushing print rate F1 is set for the white region Id, the flushing print rate F2 is set for the transparent region Ie, the flushing print rate F3 is set for the low-density color region Ic, and the flushing print rate F4 is set for the high-density color regions Ia and Ib. Such flushing data Df indicate the position of the pixel Px to which the color ink is discharged, with respect to each of the plurality of color inks used in the prestage printer 2.

The data synthesis part 933 generates synthetic data Dm by adding the flushing data Df received from the flushing data generation part 932 to the print data Dp received from the data acquisition part 91. Specifically, the synthetic data Dm is generated by adding a pixel value indicated by the flushing data Df to a pixel value indicated by the print data Dp with respect to each pixel Px.

The halftone processing part 934 performs halftone processing on the synthetic data Dm received from the data synthesis part 933. Then, the head control part 95 controls a timing at which the ink is discharged from each nozzle N of the print bar B on the basis of the synthetic data Dm after being subjected to the halftone processing. The flushing is thereby performed by discharging the ink to the pixel Px indicated by the flushing data Df, in parallel with the image printing which is performed by discharging the ink to the pixel Px indicated by the print data Dp.

In the present embodiment described above, in the printing medium M, the white region Id to which only the white ink is adhered and the color regions Ia, Ib, and Ic to which the color inks are adhered are determined on the basis of the print data Dp. Then, the flushing is performed so that the flushing print rate F1 for the white region Id becomes lower than the flushing print rates F3 and F4 for the color regions Ia, Ib, and Ic. Thus, it becomes possible to suppress the color inks discharged in the flushing from becoming outstanding in the white region Id.

Further, the control part 9 estimates the optical transparency of each of the color regions Ia, Ib, and Ic and performs the flushing so that the higher optical transparency the region has, the flushing print rate for the region becomes lower, among the color regions Ia, Ib, and Ic (F3<F4). It thereby becomes possible to suppress the color ink discharged in the flushing from becoming outstanding in the region Ic having high optical transparency.

Furthermore, the control part 9 controls the flushing print rate in accordance with the result of determining the transparent region Ie to which neither the white ink nor the color ink is adhered on the basis of the print data Dp. Particularly, the flushing print rate F1 for the white region Id is lower than the flushing print rate F2 for the transparent region Ie. It thereby becomes possible to more reliably suppress the color ink discharged in the flushing from becoming outstanding in the white region Id.

Further, the flushing print rate F2 for the transparent region Ie is lower than the flushing print rates F3 and F4 for the color regions Ia, Ib, and Ic. It thereby becomes possible to suppress the color ink discharged in the flushing from becoming outstanding in the transparent region Ie.

Furthermore, the control part 9 generates the synthetic data Dm indicating the position (pixel Px) to which the color ink is discharged, which is indicated by the print data Dp, and the position (pixel Px) to which the color ink is discharged in the flushing, and discharges the color ink to the position (pixel Px) indicated by the synthetic data Dm from the nozzles N included in the print bar B of the prestage printer 2. In such a configuration, it is possible to accurately perform the flushing in parallel with the image printing on the basis of the generated synthetic data Dm.

Further, the prestage printer 2 discharges the color inks onto the printing medium M which is transferred in the feed direction Am, and the control part 9 adjusts the flushing print rates F1 to F4 by controlling the time interval at which the prestage printer 2 discharges the color inks from the nozzles N. In such a configuration, it is possible to accurately adjust the flushing print rate by controlling the time interval at which the color inks are discharged.

Furthermore, the control part 9 changes the time interval at which the color ink is discharged in flushing between two nozzles which discharge the color ink to the positions adjacent in the orthogonal direction Ar. In such a configuration, it is possible to suppress the dots dt of the two color inks discharged in the flushing from being connected to each other and therefore becoming outstanding.

In the above-described embodiment, the printing system 1 corresponds to one example of a "printing system" of the present invention, the prestage printer 2 corresponds to one example of a "printing apparatus" of the present invention, the loading roller 21, the unloading roller 23, and the backup rollers 25 serve in cooperation as one example of a "medium supporting part" of the present invention, the print bar B of the prestage printer 2 corresponds to one example of a "color ink printing part" of the present invention, the print bar B of the post-stage printer 6 corresponds to one example of a "white ink printing part" of the present invention, the nozzle N corresponds to one example of a "nozzle" of the present invention, the control part 9 corresponds to one example of a "control part" of the present invention, the print data Dp correspond to one example of "print data" of the present invention, the synthetic data Dm correspond to one example of "synthetic data" of the present invention, the image I corresponds to one example of an "image" of the present invention, the white region Id corresponds to one example of a "white region" of the present invention, the color regions Ia, Ib, and Ic correspond to one example of a "color region" of the present invention, the transparent region Ie corresponds to one example of a "transparent region" of the present invention, the printing medium M corresponds to one example of a "printing medium" of the present invention, and the flushing print rates F1 to F4 correspond to one example of a "flushing print rate" of the present invention.

Figure 10:
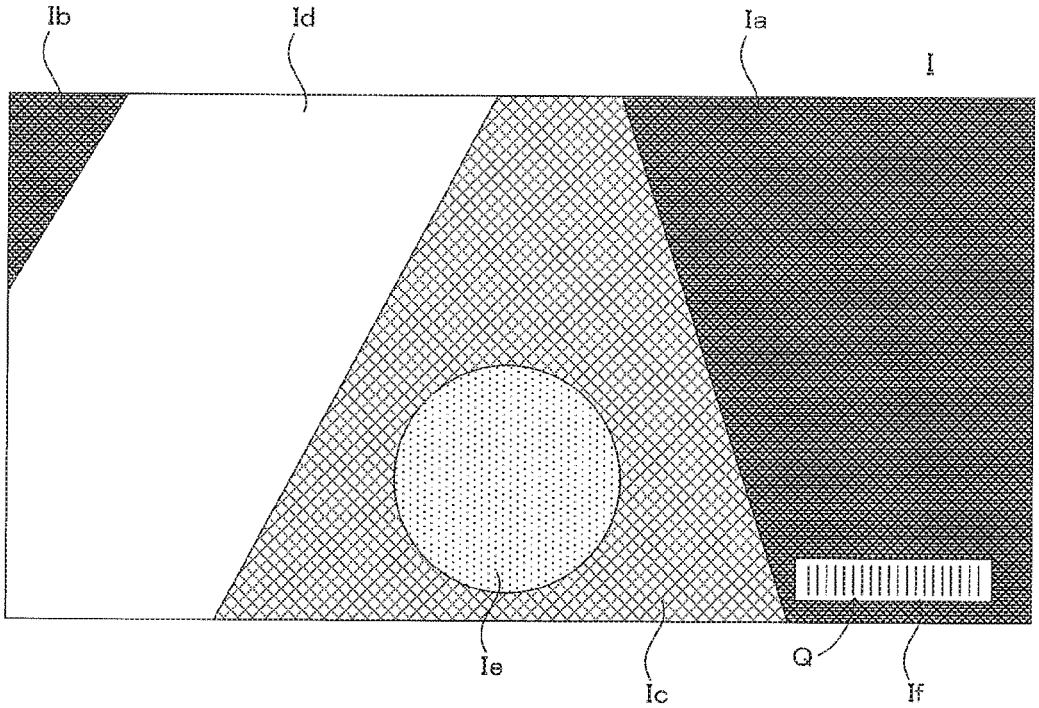
FIG. 10 is a plan view schematically showing a variation of the image to be printed on the printing medium in the image printing performed by the printing system.

The present invention is not limited to the above-described embodiment, but numerous modifications and variations other than those described above can be devised without departing from the scope of the invention. FIG. 10 is a plan view schematically showing a variation of the image to be printed on the printing medium in the image printing performed by the printing system. The variation shown in FIG. 10 is different from the exemplary case shown in FIG. 6 in that a code Q formed of a pattern representing predetermined information is printed on the front surface Ma of the printing medium M by discharge of the color inks from the print bars B in the prestage printer 2. Though the code Q is a one-dimensional bar code in this case, the code Q may be a two-dimensional bar code, a dot embedding code, or the like.

Then, the data analysis part 931 determines whether or not there is a code region If in which the code Q is printed in the printing medium M, on the basis of the print data Dp, and when there is a code region If, the data analysis part 931 specifies the location of the code region If. The determination result Dj includes the information on the code region If which is obtained thus and is sent from the data analysis part 931 to the flushing data generation part 932. Then, the flushing data generation part 932 generates the flushing data Df on the basis of this determination result Dj.

In one exemplary case, the flushing data generation part 932 generates the flushing data Df while setting the flushing print rate F for the code region If to be lower than the flushing print rates F3 and F4 for the color regions Ia, Ib, and Ic except the code region If. Thus, by controlling the flushing print rate F in accordance with the determination result on the code region If, it becomes possible to suppress the color inks discharged in the flushing from becoming a noise and a hindrance to reading of the information included in the code.

Alternatively, in another exemplary case, the flushing data generation part 932 generates the flushing data Df so that the flushing is not performed on the code region If. Thus, by controlling the flushing print rate F in accordance with the determination result on the code region If, it becomes possible to prevent the color ink discharged in the flushing from becoming a noise and a hindrance to reading of the information included in the code.

Further, the method of generating data used to perform the image printing and the flushing in parallel is not limited to the method of synthesizing the print data Dp and the flushing data Df. For example, the control part 9 may perform the processing of rewriting the tone value of the pixel Px to which the color ink is discharged in the flushing, among all the pixels Px included in the print data Dp, to "256" (specific value) on the print data Dp. By causing the head control part 95 to control each print bar B on the basis of such print data Dp, in the flushing performed in parallel with the image printing, the color ink is discharged from the prestage printer 2 to the position corresponding to the pixel Px indicating the specific value in the printing medium M. In such a configuration, it is possible to accurately perform the flushing in parallel with the image printing on the basis of the print data Dp in which the tone value is rewritten to the specific value.

Furthermore, in the above-described cases, the flushing print rates F3 and F4 are changed on two levels in accordance with the optical transparency of the color region. The flushing print rates F3 and F4, however, may be changed on three or more levels in accordance with the optical transparency of the color region.

Further, though not shown above, there may be a case where the flushing in which the white ink is discharged from the nozzles N of the print bar B in the post-stage printer 6, separately from the discharge of the white ink on the basis of the print data Dp, is performed in parallel with the image printing. In this case, the flushing print rate of the white ink can be set in conformity with the exemplary case of FIG. 9. Specifically, the flushing print rate of the white ink for the transparent region may be set to be lower than the flushing print rate for the low-density color region, and the flushing print rate of the white ink for the low-density color region may be set to be lower than the flushing print rate for the high-density color region.

Furthermore, the types of color inks to be discharged onto the printing medium M from the prestage printer 2 are not limited to the six colors described above.

Figure 5:
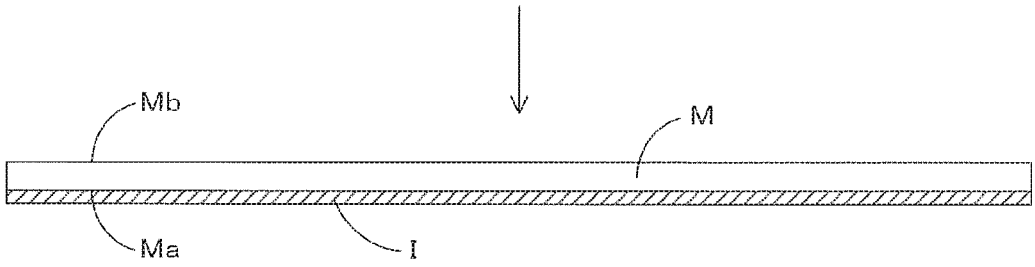
FIG. 5 is a cross sectional view schematically showing an image to be printed on a printing medium in image printing performed by the printing system.

Further, there may be a configuration where a printer for discharging the white ink is provided on the upstream side from the prestage printer 2 in the feed direction Am and the white ink is discharged onto the printing medium M and then the color inks are discharged on the printing medium M. In this case, unlike in the case shown in FIG. 5, the image I is visually recognized from the side of the front surface Ma.

Furthermore, printing of the white ink onto the printing medium M may be performed by analog printing such as flexography, photogravure, or the like.

Further, the prestage printer 2 may cause the printing medium M to stop on a platen and discharge the color inks from the nozzles N while operating the print bars B in the orthogonal direction Ar.

Furthermore, the material of the printing medium M is not limited to a film but may be paper or the like.

Further, the type of ink is not limited to the water-based ink but may be latex ink, solvent ink, or UV (Ultra Violet) ink. In a case of using the UV ink, a light irradiation apparatus that irradiates the UV ink on the printing medium M with ultraviolet rays may be provided, instead of the prestage dryer 4 and the post-stage dryer 8.

The present invention can be applied to general printing technology.

As described above, the printing apparatus may be configured so that the control part estimates an optical transparency of the color region and performs the flushing so that the higher optical transparency the color region has, the flushing print rate for the color region becomes lower. It thereby becomes possible to suppress the color ink discharged in the flushing from becoming outstanding in a region having high optical transparency.

The printing apparatus may be configured so that the printing medium is transparent, the control part controls the flushing print rate in accordance with a result of determining a transparent region to which neither the white ink nor the color ink is adhered in the printing medium on the basis of the print data, and the flushing print rate for the white region is lower than the flushing print rate for transparent region. It thereby becomes possible to more reliably suppress the color ink discharged in the flushing from becoming outstanding in the white region.

The printing apparatus may be configured so that the flushing print rate for the transparent region is lower than the flushing print rate for the color region. It thereby becomes possible to suppress the color ink discharged in the flushing from becoming outstanding in the transparent region.

The printing apparatus may be configured so that the control part controls the flushing print rate in accordance with a result of determining a code region on which a code formed of a pattern representing predetermined information is printed by the color ink printing part in the printing medium on the basis of the print data, and the flushing print rate for the code region is lower than the flushing print rate for the color region except the code region. It thereby becomes possible to suppress the color ink discharged in the flushing from becoming a noise and a hindrance to reading of the information included in the code.

The printing apparatus may be configured so that the control part determines a code region on which a code formed of a pattern representing predetermined information is printed by the color ink printing part in the printing medium on the basis of the print data, and does not perform the flushing on the code region. It thereby becomes possible to prevent the color ink discharged in the flushing from becoming a noise and a hindrance to reading of the information included in the code.

The printing apparatus may be configured so that the control part generates synthetic data indicating a position to which the color ink is discharged, which is indicated by the print data, and a position to which the color ink is discharged in the flushing, and discharges the color ink to a position indicated by the synthetic data from the color ink printing part. In such a configuration, it is possible to accurately perform the flushing in parallel with the image printing on the basis of the generated synthetic data.

The printing apparatus may be configured so that the print data indicates a tone value of each pixel, and the control part performs a processing of rewriting the tone value of the pixel to which the color ink is discharged in the flushing to a specific value on the print data and discharges the color ink to a position corresponding to the pixel having the specific value in the printing medium from the color ink printing part. In such a configuration, it is possible to accurately perform the flushing in parallel with the image printing on the basis of the print data in which the tone value is rewritten to the specific value.

The printing apparatus may be configured so that the medium supporting part feeds the printing medium in a predetermined direction, the color ink printing part discharges the color ink onto the printing medium which is fed in the predetermined direction, and the control part adjusts the flushing print rate by controlling a time interval at which the color ink printing part discharges the color ink. In such a configuration, it is possible to accurately adjust the flushing print rate by controlling the time interval at which the color ink is discharged.

The printing apparatus may be configured so that the control part changes the time interval at which the color ink is discharged in the flushing between two nozzles which discharge the color ink to the positions adjacent in the orthogonal direction orthogonal to the predetermined direction. In such a configuration, it is possible to suppress the dots of two color inks discharged in the flushing from being connected to each other and therefore becoming outstanding.

A printing system according to the invention comprises: the aforementioned printing apparatus; and a white ink printing part configured to discharge white ink from a nozzle onto a printing medium. Therefore, it becomes possible to suppress the color ink discharged in the flushing from becoming outstanding in the white region.

Thus, according to the present invention, it becomes possible to suppress the color ink discharged in the flushing from becoming outstanding in the white region.

Although the invention has been described with reference to specific embodiments, this description is not meant to be construed in a limiting sense. Various modifications of the disclosed embodiment, as well as other embodiments of the present invention, will become apparent to persons skilled in the art upon reference to the description of the invention. It is therefore contemplated that the appended claims will cover any such modifications or embodiments as fall within the true scope of the invention.

What is claimed is:

1. A printing apparatus, comprising:

a medium supporting part configured to support a printing medium;

a color ink printing part configured to discharge color ink having a color different from white from a nozzle onto the printing medium; and a control part configured to perform image printing in which an image is printed onto the printing medium by controlling discharge of the color ink from the color ink printing part on the basis of print data representing the image to be printed onto the printing medium and performing flushing in which the color ink printing part is caused to discharge the color ink, separately from the discharge of the color ink on the basis of the print data, in parallel with the image printing, wherein the control part controls a flushing print rate indicating an area to which the color ink discharged in the flushing is adhered per unit area of the printing medium in accordance with a result of determining a white region to which only white ink is adhered and a color region to which the color ink is adhered in the printing medium on the basis of the print data, wherein the flushing print rate for the white region is lower than the flushing print rate for the color region, and wherein the control part includes:

a data acquisition part that acquires print data; and a data analysis part that analyzes the print data received from the data acquisition part to determine the color region and the white region on the basis of the print data.

2. The printing apparatus according to claim 1, wherein the control part estimates an optical transparency of the color region and performs the flushing so that the higher optical transparency the color region has, the flushing print rate for the color region becomes lower.

3. The printing apparatus according to claim 1, wherein the printing medium is transparent, the control part controls the flushing print rate in accordance with a result of determining a transparent region to which neither the white ink nor the color ink is adhered in the printing medium on the basis of the print data, and the flushing print rate for the white region is lower than the flushing print rate for transparent region.

4. The printing apparatus according to claim 3, wherein the flushing print rate for the transparent region is lower than the flushing print rate for the color region.

5. The printing apparatus according to claim 1, wherein the control part controls the flushing print rate in accordance with a result of determining a code region on which a code formed of a pattern representing predetermined information is printed by the color ink printing part in the printing medium on the basis of the print data, and the flushing print rate for the code region is lower than the flushing print rate for the color region except the code region.

6. The printing apparatus according to claim 1, wherein the control part determines a code region on which a code formed of a pattern representing predetermined information is printed by the color ink printing part in the printing medium on the basis of the print data, and does not perform the flushing on the code region.

7. The printing apparatus according to claim 1, wherein the control part generates synthetic data indicating a position to which the color ink is discharged, which is indicated by the print data, and a position to which the color ink is discharged in the flushing, and discharges the color ink to a position indicated by the synthetic data from the color ink printing part.

8. The printing apparatus according to claim 1, wherein the print data indicates a tone value of each pixel, and the control part performs a processing of rewriting the tone value of the pixel to which the color ink is discharged in the flushing to a specific value on the print data and discharges the color ink to a position corresponding to the pixel having the specific value in the printing medium from the color ink printing part.

9. The printing apparatus according to claim 1, wherein the medium supporting part feeds the printing medium in a predetermined direction, the color ink printing part discharges the color ink onto the printing medium which is fed in the predetermined direction, and the control part adjusts the flushing print rate by controlling a time interval at which the color ink printing part discharges the color ink.

10. The printing apparatus according to claim 9, wherein the control part changes the time interval at which the color ink is discharged in the flushing between two nozzles which discharge the color ink to the positions adjacent in the orthogonal direction orthogonal to the predetermined direction.

11. A printing system, comprising:

the printing apparatus according to claim 1; and a white ink printing part configured to discharge white ink from a nozzle onto a printing medium.

12. A printing method, comprising:

performing image printing in which an image is printed onto a printing medium by discharging color ink having a color different from white from a nozzle on the basis of print data representing the image to be printed onto the printing medium; and performing flushing in which the color ink is discharged from the nozzle, separately from discharge of the color ink on the basis of the print data, in parallel with the image printing, wherein a flushing print rate is controlled, the flushing print rate indicating an area to which the color ink discharged in the flushing is adhered per unit area of the printing medium in accordance with a result of determining a white region to which only white ink is adhered and a color region to which the color ink is adhered in the printing medium on the basis of the print data, and wherein the flushing print rate for the white region is lower than the flushing print rate for the color region wherein the printing method further comprises acquiring print data; and wherein the print data is analyzed to determine the color region and the white region on the basis of the print data.

* * * * *